United States Patent [19]

Tinnes et al.

[11] Patent Number: 4,770,230

[45] Date of Patent: Sep. 13, 1988

[54] PROCESS AND APPARATUS FOR STARTING A CONTINUOUS CASTING PLANT

[75] Inventors: Bernhard Tinnes, Zollikerberg, Switzerland; Heinz Kreuzberg, Bernau, Fed. Rep. of Germany

[73] Assignee: Metacon Aktiengesellschaft, Zurich, Switzerland

[21] Appl. No.: 822,223

[22] Filed: Jan. 24, 1986

[30] Foreign Application Priority Data

Mar. 19, 1985 [DE] Fed. Rep. of Germany ..... 3509932

[51] Int. Cl.[4] ..... B22D 11/04; B22D 11/08

[52] U.S. Cl. ..... 164/483; 164/488; 164/155; 164/449

[58] Field of Search ..... 164/483, 449, 453, 155, 164/488

[56] References Cited

U.S. PATENT DOCUMENTS 4,567,935 2/1986 Takeda et al. ..... 164/450

FOREIGN PATENT DOCUMENTS 3221708 2/1984 Fed. Rep. of Germany ..... 164/483
165553 12/1981 Japan ..... 164/449
9757 1/1983 Japan ..... 164/453
84652 5/1983 Japan ..... 164/453
42590 10/1984 Japan ..... 164/449
2163983 3/1986 United Kingdom .
505336 5/1976 U.S.S.R. .
551108 6/1977 U.S.S.R. ..... 164/449
1006050 3/1983 U.S.S.R. ..... 164/449
1060300 12/1983 U.S.S.R. ..... 164/453

*Primary Examiner*—Nicholas P. Godici
*Assistant Examiner*—Samuel M. Heinrich
*Attorney, Agent, or Firm*—Wenderoth, Lind & Ponack

[57] ABSTRACT

A process and apparatus for starting a continuous casting plant, which involves the filling of the empty area over the dummy bar of an ingot mold to the desired filling level, is simplified while achieving improved operating safety. To this end, a controllable spout closure, which is completely open during the starting of the casting of the molten metal into a tundish, is brought into a predetermined throttle position by the actual filling level rising in the ingot mold to a first signal level and thereafter the further rise of the actual filling level is monitored and controlled, if necessary, in accordance with a second signal level of a predetermined characteristic time curve by logically changing the throttle position of the spout closure. It is thereby possible to control the actual filling level rising in the ingot mold so as to reach its desired filling level without undue risk.

9 Claims, 2 Drawing Sheets

PROCESS AND APPARATUS FOR STARTING A CONTINUOUS CASTING PLANT

CROSS REFERENCE TO RELATED APPLICATIONS

The present application is related to copending U.S. patent application Ser. No. 772,747, filed on Sept. 4, 1985 and bearing common inventorship with the present application, and is also related to copending U.S. patent application Ser. No. 746,847, filed on June 20, 1985 and invented by a co-inventor of the present application.

BACKGROUND OF THE INVENTION

The present invention relates to a process and apparatus for starting a continuous casting plant. More particularly, the present invention relates to a process and apparatus for starting a plant for casting molten steel into a permanent mold by means of a controllable spout closure mounted on a tundish, and in which, due to a constant pulling speed of the extrusion which is maintained by a measuring and controlling means, the bath level is kept at a predetermined level within a measuring section. The present invention further relates to a process and apparatus for the automatic start-up of a continuous casting plant in which molten steel is filled from a tundish over a controllable spout closure into a continuous casting mold and the instantaneous bath level rising therein is controlled along a given start-of-casting curve into a desired bath level maintained during casting by means of measuring and control devices, the drive for the withdrawal of the cast bar being triggered at a predetermined instantaneous bath level.

West German OS Patent Application No. 29 289 01 discloses a prior art process for the start of a casting plant for the continuous casting of metals, according to which the bath level in the mold, serving as a source of radiation, is monitored by an optical radiation receiver directed perpendicularly thereto; the receiver controls an actuator for the stopper rod of a tundish. In this system, it is essential that the charging of the metal into the mold and the start of the lowering of the dummy bar head or the dummy bar occur in accordance with the distance between the radiation source and the radiation receiver. However, steps for carrying out the process have not been specified and, moreover, optical measuring instruments have not proven reliable in the actual performance of the casting operation.

Basically, there are controlling means for the automatic operation of continuous casting plants using a variety of measuring instruments mostly of the radiometric or electromagnetic variety. The instruments monitor the bath level in the mold and the controlling means control the pulling of the cast strand, during which the molten steel flows to the mold through a nozzle having a constant aperture and the pulling speed of the strand is controlled. Furthermore, when the flow control is used as the preferred technology, the pulling speed of the strand remains constant and the flow of the molten steel to the mold is controlled, preferably by use of a sliding gate valve which meets control-engineering requirements more easily than, for example, a stopper rod. In the case of the control of both the pulling of the strand and of the molten steel flow, it is necessary to automatically observe a selected desired level in the mold within a measuring section monitored by a measuring instrument.

West German Patent No. 32 21 708 relates to a method and the apparatus used therefor. In this case, the empty mold is filled with molten metal in two phases over the dummy bar, namely, in an intermittent filling phase A-B and in a continuous filling phase B-D. In the A-B phase, the filling occurs in gulps by constantly opening and closing the spout closure in the tundish, while in the B-D phase, the filling occurs continuously. Both filling operations A-B and B-D are controlled along a preprogrammed start-of-casting curve (time curve) in which comparisons between desired bath levels that have been input and the particular instantaneous bath levels measured by an optical level indicator occur with proper corrections at the spout closure. The repeated full closing of the filling phase A-B, which starts with an opening procedure, is provided to quiet the steel level between the casting gulps in order to determine the particular instantaneous bath level in the mold. This is a relatively complex process that not only puts a strain on the spout closure of the tundish, particularly on its refractory wear parts, but also takes a considerable amount of time. In addition, particularly if a slide gate is employed as spout closure during the intermittent opening, which occurs with constant opening values but without completely opening the spout closure, there is greater danger of clogging of the passageway during the start of casting, despite the fact that the tundish and the spout closure are preheated. In this connection, it is pointed out that, as molten metal is charged into the tundish, the ladle lip remains closed. Moreover, optical measuring devices have not stood the test in foundry work.

SUMMARY OF THE INVENTION

In contrast, the present invention is concerned with the starting of a continuous casting plant equipped with a flow control even before the control of the desired level control has been initiated, that is to say, during the interval between the start of casting—which is equivalent to the feeding of the molten metal into the preheated tundish which charges the mold including the closure spout—and the obtaining of the desired bath level. It is an object of the invention to establish an optimum start-up process in a recurrent manner for this interval with predetermined process steps, including the turn-on of the extrusion puller. The start-up process reliably causes the proper solidification of the bar at the dummy bar head and the warming up of the sliding gate valve.

In this regard, it should also be pointed out that heretobefore, during the charging of the tundish with molten metal, the spout closure was kept shut so as to prevent molten metal from freezing in the discharge port.

The problem set forth above is solved by the present invention in which the spout closure is fully opened during the start of casting into the tundish. The actual level of the molten metal rises in the mold until, in response to the level reaching a first signal level, the spout closure is reduced to a preset throttling position in order to control the further rise of the actual level up to a predetermined level. The extrusion puller is turned on in response to the actual level reaching a second signal level. In this way, it is possible for the actual level to rise smoothly and purposefully to the desired level while providing sufficient time for the extrusion to solidify and to enable the spout closure to adapt itself sufficiently to the operating temperature as a result of the adequately flowing molten metal. Thus, damage to the extrusion due to abrasion and further cloggings in the opening of the spout closure caused by the freezing of the melt are prevented and the conditions for an optimum starting operation are satisfied.

In general, the throttling position of the sliding gate valve and of the further rise of the actual level initiated thereby, as well as the instant for starting the extrusion puller, are essentially functions of the solidification process in the mold for the extruded product and of the warming-up process in the sliding gate valve depending upon the cross section of the strand and the physical properties of the melt. Accordingly, special time constraints are developed for the process steps, whereby one considers as limiting criteria the keeping of the spout closure fully open for as long a time as possible and the avoidance of an overfill of the mold.

Another aspect of the invention is seen in the fact that, once the extrusion puller has been started, a controllable pulling speed is used to contribute to the determination of the time characteristic curve which thereby permits more extensive control options.

With respect to the throttling position of the spout closure, it has been found that this should occur at 25 to 65 percent of the total level of the mold, and the full opening of the closure should occur from 5 to 30 percent of the maximum opening for billet and small bloom molds and from 15 to 50 percent of the maximum opening for large bloom and billet molds. All current extrusion formats can be taken into account with these regions.

To carry out the process in accordance with the present invention, an arrangement has proved successful which is provided with thermocouples for detecting the signal levels and which operate in the ingot wall as discrete point measuring stations and which are located below the measuring instrument used to monitor the desired level. Such an arrangement can be arranged even in the extremely confined space conditions found in the mold environment. If, on the other hand, there is adequate space, then an arrangement is preferred with a standard measuring instrument that extends over the entire mold height.

It is the object of the present invention to simplify the start of casting and the apparatus used therefor, while improving the reliability of operation.

According to the present invention, this object is achieved in that during the start of casting of the molten metal into the tundish, the spount closure, which is fully open during the start of casting of the molten metal into the tundish, is brought from the instantaneous bath level that rises in the mold at a first signal level to a predetermined throttle position, and thereafter the further rise of the instantaneous bath level is monitored and, if necessary, corrected at a second signal level of a predetermined time curve by varying said throttle position. In this way, during the charging of the tundish, molten metal flows immediately through the spout closure into the mold from the tundish and there is no danger that the rising bath level will distort the data being measured. This bath level changes gently and purposefully to the desired bath level with only one check and is corrected with a single, simple signal level. On one hand, the new bar has enough time to solidify, while on the other hand, the spout closure is adjusted to the operating temperature by the molten metal flowing therethrough in sufficient quantity. In this manner, damage to the bar by breaking, as well as clogging in the passage opening of the spout closure caused by a freezing of the molten metal are largely prevented, so that the prerequisites for an optimum start-up are satisfied.

Basically, the throttle position of the slide gate and the further rise of the instantanous bath level triggered thereby, as well as the instant for the triggering the bar withdrawal, are functions of the bar-solidifying process in the mold and of the warming-up process in the slide gate in dependence upon cross section of the bar and the physical properties of the molten metal. Accordingly, specific time sequences or time curves for the process steps are laid down for each bar size, such that maintainig the spout closure fully open as long as possible and preventing an overfill of the mold are looked upon as the limiting criteria.

In a preferred method of the so-called open start-of-casting in accordance with the present invention, it is of advantage to proceed in such a way that the control of the instantaneous bath level by use of signal levels along the time curve changes over to a control of the desired bath level occurring within a test section and the changeover is effected by further throttling of the spout closure into the operating postition at one signal level of the test section. This combination of controls along a time curve having only one monitoring signal level with subsequent test-section control, which is triggered into the operating position within the desired-level range by further throttling of the spout closure contributes to a considerable extent to a reliable run of the start-of-casting process. In the operating position, the spout closure assumes a position in which equal allowance can be made for opening and closing commands for maintaining the desired bath level.

Other features of the present invention are seen in the fact that, particularly if bars are cast that have fairly large cross-sections, the start of the bar withdrawal occurs at the same time as the throttling of the spout closure into the operating position, while in the case of bars with rather small cross-sections, the start of the bar withdrawal occurs advantageously in the terminal range of the time curve, in the further run of which the influence of the speed on the bar withdrawal is taken into consideration. It is likewise of advantage to trigger the throttle position of the spout closure located at the start of the time curve within a range of from 25 to 65% of the entire filling height available in the mold and thereby to trigger the throttling in the case of billet molds or small cogged-ingot molds at 5 to 30% of the full approach angle, and in the case of slab molds or large cogged-ingot molds at 15 to 50%. All current bar sizes can be handled with these ranges.

To carry out the process in accordance with the present invention, it has proven advantageous to use a measuring apparatus that has thermoelements for the signal levels that act as point measuring stations underneath the measuring device in the mold wall which serves to monitor the desired bath level. Such apparatus fits nicely into the tightest places, such as are usually found in the vicinity of an ingot mold.

BRIEF DESCRIPTION OF THE DRAWINGS

The invention will now be described with reference to the accompanying drawings, in which.

DESCRIPTION OF THE PREFERRED EMBODIMENT

Figure 1:
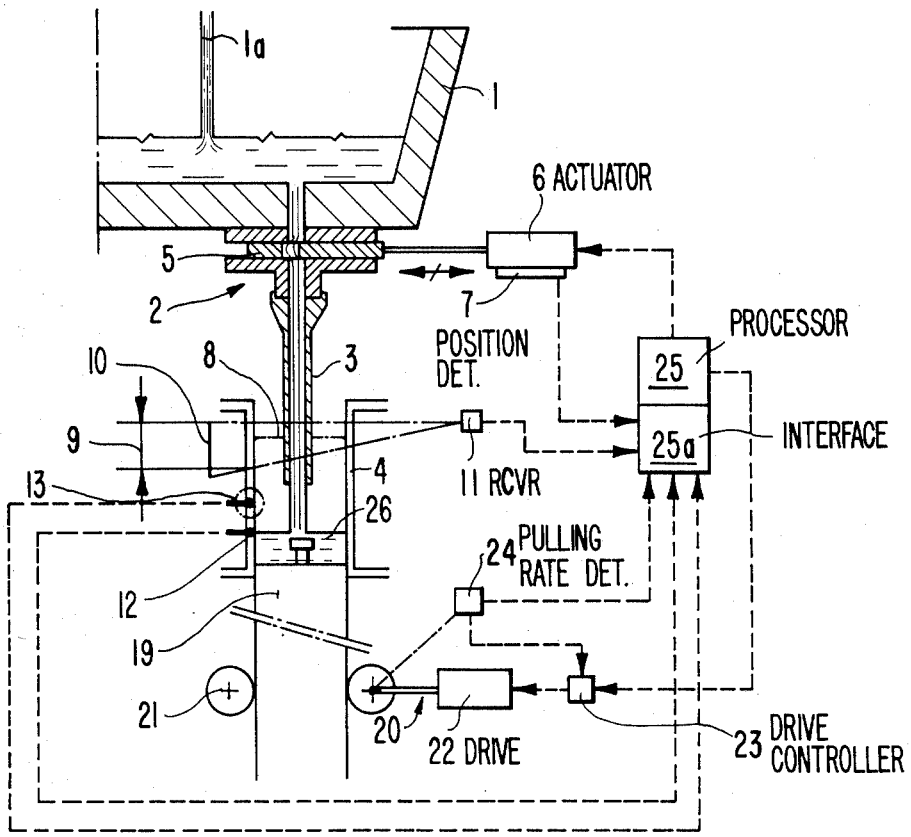
FIG. 1 is a schematic diagram of a continuous casting plant.
Figure 2:
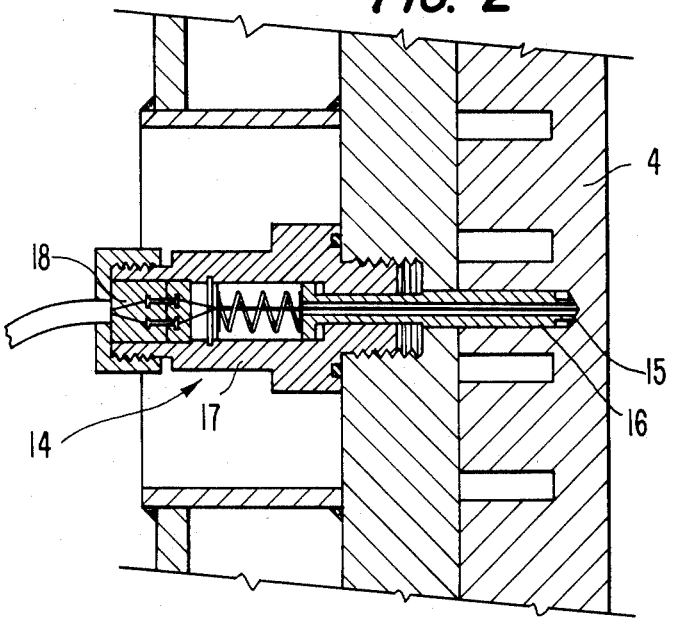
FIG. 2 is a clarification of the measuring station 13 shown in FIG. 1.

Now, referring to FIG. 1, numeral 1 denotes a tundish which shall be fed by means of a pouring stream 1*a* and from which molten steel is fed in batches through a controllable spout closure in the form of a sliding gate valve 2, and through a casting tube 3 of a water-cooled continuous casting mold 4 connected thereto. To this end, the sliding plate 5 of the sliding gate valve 2 is coupled mechanically to an actuator 6, while keeping the same free from play, and whose operating position at any given time is recorded by a position detector 7. The free end of the casting tube 3 extends into the mold 4, whose desired level 8 is monitored within a measuring station 9 by a measuring instrument composed of a rod type radiation emitter 10 and a receiver 11. Beneath the rod emitter 10 and receiver 11 there are provided on the mold 4 measuring stations 12 and 13 with a vertical distance therebetween. As is apparent from FIG. 2, they have replaceable temperature sensors 14 built into the wall of the mold 4 and which essentially consist of a thermocouple 15 (preferably an PTC or NTC thermistor), a pressure-spring-loaded barrel 16, a nipple 17, and an electrical terminal joint 18.

Downstream of the mold 4 there is mounted, first, a secondary cooling system which is not shown for the sake of simplicity, and then an extrusion puller 20 that grips a dummy bar 19. The puller includes drive rollers 21 and the drive 22 thereof, as well as a drive controller 23 and a pulling rate detector 24. The detector 24 transmits its data, on the one hand, to a processor 25 through an interface 25*a*, which also receives and processes the data from the position detector 7 which monitors the degree of opening of the sliding gate valve 2 and the data from the receiver 11 as well as data from the measuring stations 12 and 13, and transmits control commands to the actuator 6 of the sliding gate valve 2 and to the drive controller 23 of the extrusion puller 20. The pulling speed is set at a constant value, with a constant pulling speed of the extruded product above the dummy bar 19, the desired level 8 in the mold 4 is controlled predominantly from the flow side alone by the sliding gate valve 2, but nevertheless, under casting conditions that go beyond the control range of the sliding gate valve 2, one can control the pulling speed, more particularly by means of the driver controller 23 of the extrusion puller 20.

Figure 4:
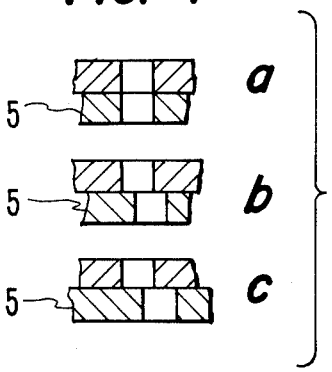
FIG. 4 shows positions of a spout closure designed as a sliding gate valve.
Figure 3:
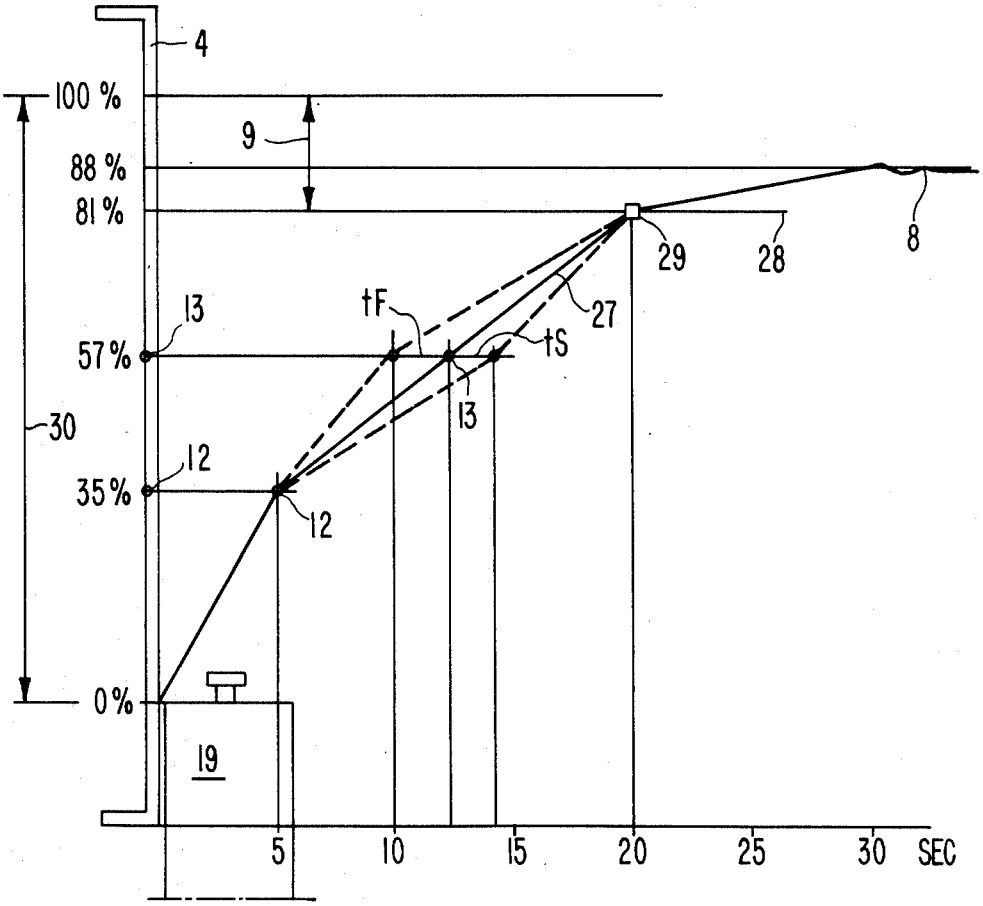
FIG. 3 is a diagram for the start of casting of the plant.

FIG. 3 shows the start of a system in the case of a bloom with 230×230 mm edge length. At the start of casting, the dummy bar 19 is moved into position, the extrusion puller 22 is switched off and the sliding gate valve is brought to the fully open position shown in FIG. 4*a*, so that an actual level 26 as shown in FIG. 1 is formed above the dummy bar 19, which rapidly levels out at the signal level of the measuring station 12, thereby initiating the moving of the sliding gate valve 2 to the throttling position shown in FIG. 4*b*. This reduces the rate of climb of the actual level 26 and, at the same time, it is guided along a time characteristic curve 27 (see FIG. 3) selected in the processor 25 until it reaches the lower signal position 28 of the measuring station 9, where the starting 29 of the extrusion puller 20 occurs and, at the same time, the attainment of the normal casting operation with the moving into the operating position, shown in FIG. 4*c*, of the sliding gate valve for controlling the bath so as to be at the desired level 8 within the measuring station 9. The actual level 8 is reached after about 30 seconds, while the start 29 of the extrusion puller 22 occurs after 20 seconds and the lowering of the rate of climb of the actual level 26 is initiated after 5 seconds. In the process, the measuring stations 29 and 12 lie at approximately 81 percent and 35 percent of the total level range available in the mold 4 above the dummy bar 29 which is of course 100 percent.

To monitor the course of the predetermined time characteristic curve 27, the signal level of the measuring station 13 is monitored to determine if the actual level 26 is rising too slowly or too quickly. If there are time differences such as, for example, tF or tS, then, appropriate actuating motions are imparted to the actuator 6 of the sliding gate valve 2 for carrying out a correction.

Figure 5:
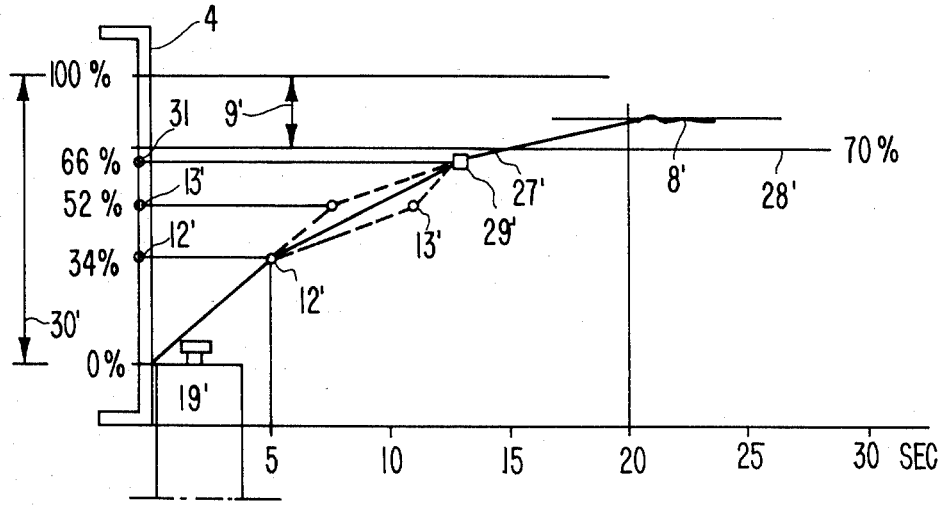
FIG. 5 shows a second practical example of a start-up program.

In small strand sections, one can manage with shorter starting times, due to a better solidification of the strand in the mold 4', as shown in FIG. 5, according to which the adjustment to the actual level 8' is already completed after 20 seconds. In this case, the start 29' of the drive 22 for the extrusion puller 20 occurs before the actual level 26 has arrived at the lower signal level 28' of the measuring station 9'. This is accomplished by means of another measuring station 31 which, like the measuring stations 12' and 13', consists of a temperature sensor 14.

We claim:

1. A process for the automatic start-up of a continuous casting plant in which molten metal is charged from a tundish via a controllable spout closure into a continuous casting mold and in which the instantaneous bath level rising therein is controlled in accordance with a predetermined start-of-casting curve so as to reach a desired bath level which is to be maintained during casting using measuring and control means, the process comprising the steps of: starting a drive means for pulling the cast bar at a predetermined instantaneous bath level; throttling the spout closure, which is initially fully open during the start of casting of the molten metal into the tundish, to a predetermined throttle position when instantaneous bath level in the mold has risen to a first signal level of a predetermined time curve; and thereafter, monitoring the further rise of the instantaneous bath level and correcting the throttle position of the closure of the spout in accordance with a second signal level of the predetermined time curve.

2. A process a recited in claim 1, wherein the control of the instantaneous bath level at the first and second signal levels along the predetermined time curve is changed over into a control of the desired bath level occurring within a predetermined measuring section, and wherein the changeover is carried out by further throttling of the spout closure at one predetermined signal level of the measuring section.

3. A process as recited in claim 2, wherein the starting of the bar removal by the drive means is set to occur at the same time as the further throttling of the spout closure.

4. A process as recited in claim 2, wherein the starting of the bar removal by the drive means is set to occur in a terminal range of the predetermined time curve in accordance with the speed of the bar withdrawal.

5. A process as recited in claim 2, wherein the throttling of the spout closure to said predetermined position occurs at a point which is 25 to 65 percent of the total level of the mold and the amount of throttling of the closure is from 5 to 30 percent of the maximum opening for billet and small bloom molds and from 15 to 50 percent of the maximum opening for large bloom and slab molds.

6. A process as recited in claim 3, wherein the throttling of the spout closure to said predetermined position occurs at a point which is 25 to 65 percent of the total level of the mold and the amount of throttling of the closure is from 5 to 30 percent of the maximum opening for billet and small bloom molds and from 15 to 50 percent of the maximum opening for large bloom and slab molds.

7. A process as recited in claim 4, wherein the throttling of the spout closure to said predetermined position occurs at a point which is 25 to 65 percent of the total level of the mold and the amount of throttling of the closure is from 5 to 30 percent of the maximum opening for billet and small bloom molds and from 15 to 50 percent of the maximum opening for large bloom and slab molds.

8. A process as recited in claim 1, wherein the throttling position of the spout closure occurs at a point which is 25 to 65 percent of the total level of the mold and the amount of throttling of the closure is from 5 to 30 percent of the maximum opening for billet and small bloom molds and from 15 to 50 percent of the maximum opening for large bloom and slab molds.

9. An apparatus for the automatic start-up of a continuous casting plant in which molten metal is charged from a tundish via a controllable spout closure into a continuous casting mode and in which the instantaneous bath level rising therein is controlled in accordance with a predetermined start-of-casting curve so as to reach a desired bath level which is to be maintained during casting using measuring and control means, the apparatus comprising:

a means for starting a drive means for pulling a cast bar form the continuus casting mold at a predetermined instantaneous bath level;

a means for throttling the spout closure, which is initially fully open during the start of casting of the molten metal into the tundish, to a predetermined throttle position when the instantaneous bath level in the mold has risen to a first signal level of a prdetermined time curve;

a means for monitoring the further rise of the instantaneous bath level and correcting the throttle position of the closure of the spout in accordance with a second signal level of said predetermined time curve;

wherein temperature sensors are provided for monitoring the bath level.

* * * * *